United States Patent [19]

Cunningham

[11] Patent Number: 4,558,747

[45] Date of Patent: Dec. 17, 1985

[54] IMPACT DEVICES

[76] Inventor: James D. Cunningham, 2100 Topaz, Boulder, Colo. 80302

[21] Appl. No.: 691,377

[22] Filed: Jan. 15, 1985

Related U.S. Application Data

[63] Continuation of Ser. No. 407,089, Aug. 11, 1982, abandoned.

[51] Int. Cl.[4] ..... E21B 1/00

[52] U.S. Cl. ..... 173/55; 173/18; 173/121; 173/124; 173/139; 173/126

[58] Field of Search ..... 173/13, 18, 19, 53, 173/55, 121, 124, 139, 126; 74/665 GE; 474/86, 32–34, 11, 70, 25, 75, 100, 118, 120; 524/34; 226/184

[56] References Cited

U.S. PATENT DOCUMENTS

| | | | |
|---|---|---|---|
| 2,519,723 | 8/1950 | Wearn | 474/33 |
| 2,584,979 | 2/1952 | Bassinger | 173/121 |
| 3,566,978 | 2/1971 | Udert | 173/139 |
| 3,792,740 | 2/1974 | Cooley | 173/139 |
| 3,919,141 | 11/1975 | Quattrociocchi | 524/34 |
| 4,121,745 | 10/1978 | Smith et al. | 227/8 |
| 4,122,904 | 10/1978 | Haytayan | 173/139 |
| 4,323,127 | 4/1982 | Cunningham | 173/53 |

*Primary Examiner*—Donald R. Schran
*Assistant Examiner*—James L. Wolfe
*Attorney, Agent, or Firm*—Edwin L. Spangler, Jr.

[57] ABSTRACT

A pair of rotating flywheels which engage a ram for moving a tool which impacts a part, such as a nail to be driven, are rotated in opposite directions from a single motor or other rotating means, through a pair of substantially identical gears, one of which drives one flywheel and the other of which drives the other flywheel. The drive connection between the respective gears and each of the flywheels may include a belt and pulley arrangement, so that each flywheel may be driven directly by the respective belt but the flywheels are pivoted toward and away from the ram so that when the flywheel moves toward the corresponding side of the ram, the connection between the belt and the corresponding pulley will tend to slacken. A special flywheel pulley has an inner V-shaped groove and parallel side walls for guiding the belt into the groove when full tension occurs. A pair of sockets for receiving pivot pins for the respective flywheels are connected by a bar which is integral with a corresponding end plate and not only withstand precession forces but also tensile forces. A friction surface on the ram, particularly when the flywheel peripheries are polished steel, is a fabric layer of natural fiber, such as long fiber cotton cloth, impregnated by and molded in polyurethane, i.e. a natural fiber embedded in a medium hard plastic or rubber. A bumper has a pyramidal socket to engage a corresponding end of the ram on its return.

19 Claims, 20 Drawing Figures

Fig.-9
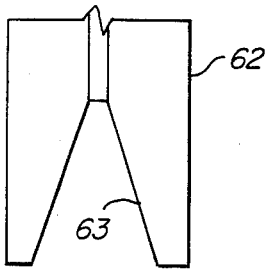
Fig.-10
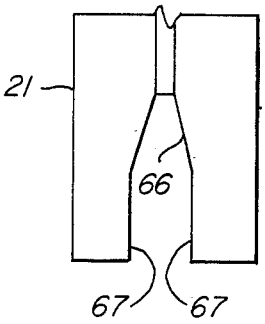
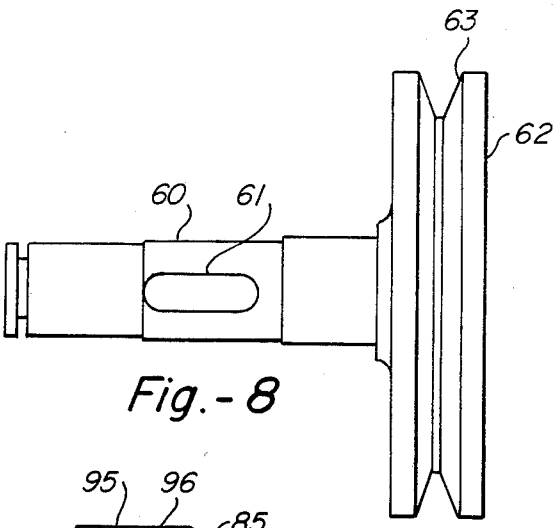
Fig.-8
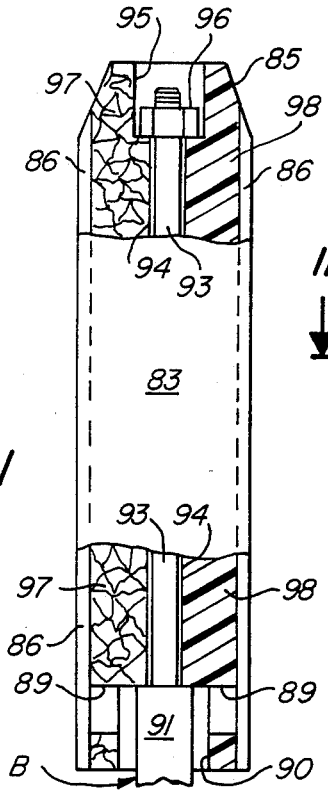
Fig.-11
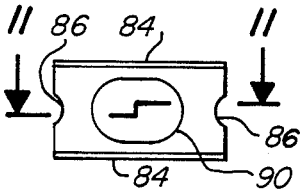
Fig.-13
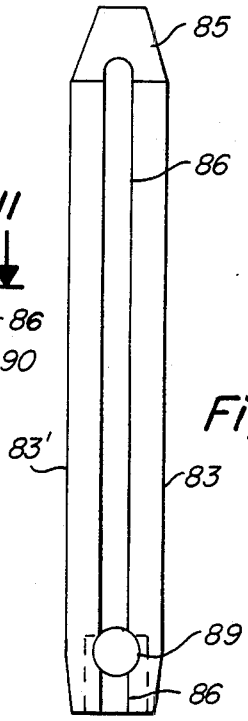
Fig.-12

IMPACT DEVICES

This application is a continuation of application Ser. No. 407,089, filed Aug. 11, 1982, now abandoned.

This invention relates to impact tools.

BACKGROUND OF THE INVENTION

In U.S. Pat. No. 4,042,036, an electrical impact tool particularly adapted for driving nails utilizes one stationarily mounted and one pivotally mounted motor and rotating flywheel assembly, with the pivotally mounted flywheel being moved toward a ram and pushing the ram against the stationarily mounted flywheel, The flywheels are rotated in opposite directions, such that engagement of each with the ram will drive the ram in the desired direction. Each motion is produced by a movable nosepiece which is pushed into engagement with the work. U.S. Pat. No. 4,323,127 discloses a pair of pivotally mounted, motor driven flywheels moved essentially simultaneously into engagement with a ram disposed between them, as by a solenoid whose force is enhanced by a linkage system having a higher mechanical advantage at the start of movement, which offsets the lower pull of the solenoid at the start of movement. The ram is provided with a taper on each side at the end initially engaged by the flywheels, so as to cause the flywheels to be wedged apart as the ram movement starts, thereby increasing the compressive forces of the ram against the flywheels and enhancing the force transmitted by friction between the flywheels and the ram. The housing in which the ram and flywheels are mounted is provided with one or two tension rods which connect the pivot mounts of opposed flywheels, in order to equalize precession forces and also to withstand other forces exerted in opposite directions against the flywheels by the ram, without increasing the weight of the housing.

The ram is returned to its initial position by an elastic shock cord, also known as a bungee cord, which is composed of numerous elastomer fibers enclosed within a sheath which appear to be more capable of repeated extensions and retractions than a coil spring, for instance, without failing due to repetitive stress. Although the impact device disclosed by this patent is highly effective, the weight of two motors, in a hand held tool particularly adapted to drive nails and the like, leaves room for improvement. In addition, the friction material, with which the sides of the ram previously are provided, such as brake lining, is highly effective for a period of time, but ultimately is subject to undue wear. In addition, a direct drive between a motor and flywheel causes the motor to reduce speed when the flywheel is reduced in speed, due to loss of inertia through transmission of a driving force to the ram. The necessary capacity for acceleration of the motor, to bring the flywheel up to the desired speed for the next operation, has resulted in an undue expense for a tool which is to be marketed in large quantities.

Among the objects of this invention are to provide an impact tool the weight of which may be reduced by utilizing a single motor to drive a pair of flywheels; to provide such a tool in which a sequence of operations may be carried out in a shorter period of time, through enhancing the accelerating capacity of a drive motor by providing a drive connection means between the drive motor or rotative drive means, such that the speed of the motor is not reduced in proportion to the reduction of speed of the flywheels due to loss of inertia in imparting driving force to a ram; to provide such an impact tool in which the drive to each of a pair of pivoted flywheels is through a pulley and belt arrangement, in which the distance between the pulleys is decreased as the flywheels engage the ram, so that the coupling between the belts and the flywheels will lessen, and a reduction in speed of the flywheels will not be reflected to the same extent in the speed of the drive means; to provide such an impact tool in which the tension members connecting the pivot points of opposed pivotal flywheels are formed integrally with opposed housing plates, thereby reducing the cost of construction, particularly assembly of the tool; to provide such an impact tool in which a drive and two separate flywheels may proceed from a single motor or other driving means, as through intermeshing and oppositely. rotating gears, only one of which is driven by the motor or drive means; to provide such a tool which is light in weight, fast in operation and is long wearing and has an extended life.

SUMMARY OF THE INVENTION

The weight of the tool is reduced py employing a single motor or rotative driving means and transferring rotation to a pair of rotating members or flywheels, individually pivotally mounted on opposite sides of a ram to be driven, which carries a blade or the like for impacting a desired object, such as a nail. The drive arrangement includes a gear driven by the drive means and engaging two gears from which one of the flywheels is rotated, the first gear in turn engaging a second gear of the same pitch diameter or number of teeth, with the second flywheel being driven from this second gear. In order to permit the first and second gears to be mounted in a stationary position and the flywheels to pivot, the drive from the respective first and second gears may be through a separate belt and pulley mounted for driving the respective flywheel In order to prevent the speed of the motor or drive means from being reduced in proportion to the speed of rotation of the flywheels, as they are slowed down due to the reduction of inertia through the transfer of a driving force to the ram, each flywheel may be pivotal about a suitable axis in a direction which causes the distance between a separate pulley driven by the respective first and second gears and separate pulleys attached to the drives of the respective flywheels to be reduced. In effect, the belt connecting the respective first and second pulley with the respective flywheel pulley will tend to slip on the latter, in the sense that the engagement of the belt with the respective flywheel pulley will be reduced, i.e. the tension of the belt on the respective pulley will decrease. A preferred construction of the flywheel pulleys is a V-shaped groove which is adapted essentially to securely engage the flywheel pulley when the flywheel is away from the ram, together with parallel side walls which will guide the pulley into the groove when full tension again occurs, but will also maintain the belt in alignment with the pulley but without engagement with the inner groove. A further improvement is the use of a hollow housing which may be made of lighter and less strong material, such as plastic, attached to an end plate, with a pair of end plates attached thereto and formed of a material having a greater strength, such as steel. Such a plate may carry a pair of sockets or the like for receiving the pivot pins for the respective flywheels, with these sockets being connected by a bar which is integral with the corresponding end plate. These bars not only withstand the stress of opposing precession forces, produced in opposite directions by the oppositely rotating flywheels, but more significantly, the opposing tensile forces produced by the reaction of the compression forces between the opposed flywheels and the sides of the ram. A further feature is a spring which returns each flywheel to its initial position away from the ram and a pivotal connection between a cup which receives one end of the spring and a special housing for the corresponding flywheel, particularly when the flywheels are moved into engagement with the ram through a system actuated by a rod which engages the work and thereby is adapted to actuate the tool when it is placed against a workpiece for driving a nail therein.

An additional significant feature of this invention is the material of which the friction surface engageable by the respective flywheel is formed. A substantial number of tests have indicated that a sufficiently high coefficient of friction accompanied by a sufficient resistance to wear is produced, particularly when the periphery of the flywheels is polished steel, when the side surfaces of the ram are formed by a fabric layer of natural fiber, preferably long fiber cotton cloth, impregnated by and molded in a suitable plastic, preferably polyurethane. The entire body of the ram may be formed of such fabric layers and plastic. In this event, a blade or similar tool may be provided with a stem or rod which extends from the lower to the upper end of the ram, being attached to the blade at the lower end and attached to the body at the upper end of the ram. Each side surface of an alternative ram is formed of a natural fiber embedded and molded in a suitable plastic, but the central portion of the ram may comprise an insert of material of a higher strength, such as metal, having attachment means for the blade, such as a threaded socket at the lower end and a series of spaced fingers extending upwardly within the molded plastic.

A special bumper having a correspondingly shaped socket, may be provided for the upper end of the ram when the latter is pyramidal in shape. Also, a bumper for the lower end of the ram, which is impacted by the ram only if the ram is moved slightly further than normal, may be attached to the upper end of a conventional nose piece.

The ram, an elastic cord and a plate to which the cord is attached and through which the ram may move to engage the upper bumper, may form a readily replaceable unit or sub-assembly for cord or ram replacement, when access thereto is readily provided, such as when the upper bumper is readily removable.

THE DRAWINGS

In the Drawings:

FIG. 8 is a side elevation of a pulley of FIG. 6 and an integral shaft therefor.

FIG. 9 is a fragmentary portion of a pulley of FIG. 3, on an enlarged scale.

Figure 3:
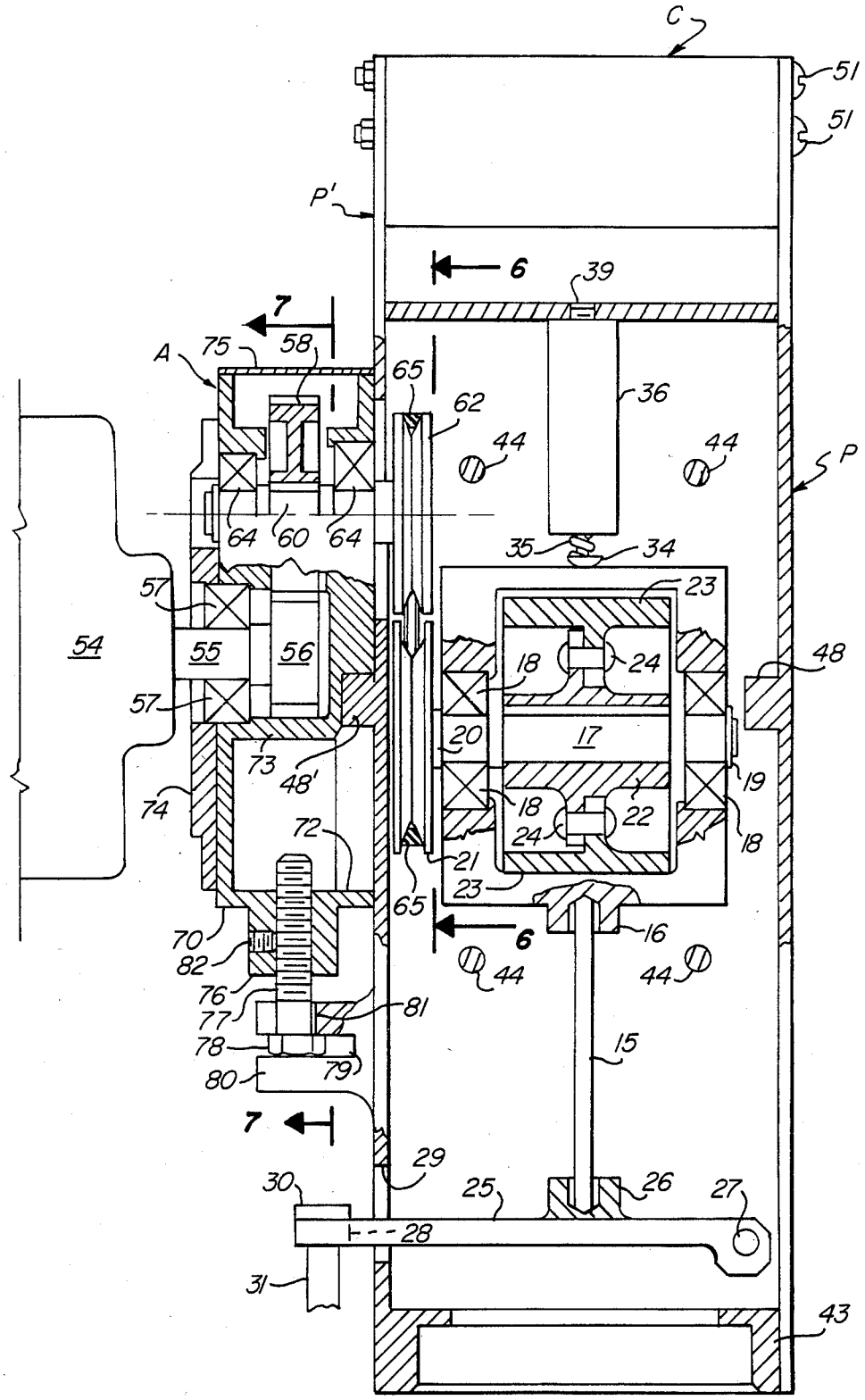
FIG. 3 is an offset longitudinal section taken along line 3—3 of FIG. 2, the left portion of the view being broken away to the longitudinal center, of FIG. 2 to show a dual drive arrangement.

FIG. 10. is a fragmentary portion of another pulley of FIG. 3, also on an enlarged scale.

Figure 2:
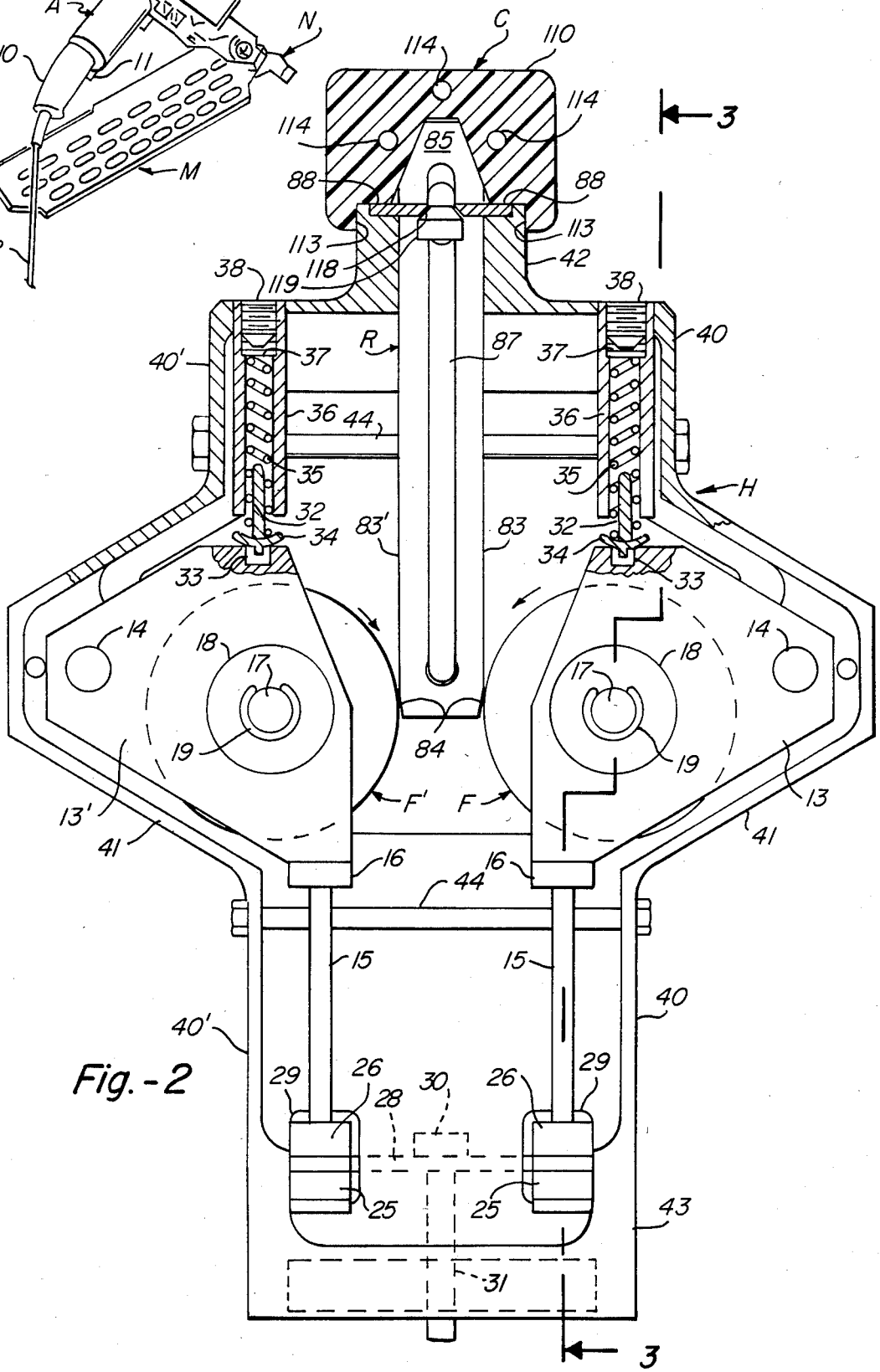
FIG. 2 is a transverse longitudinal section, on an enlarged scale, taken along line 2—2 of FIG. 1.

FIG. 11 is an offset section, taken along line 11—11 of FIG. 13, of a drive ram which is engaged at selected times, by a pair of rotors or flywheels of FIGS. 2 and 3.

FIG. 12 is a an end elevation of the drive ram of FIG. 11.

FIG. 13 is a bottom plan view of the drive ram of FIGS. 11 and 12.

Figure 14:
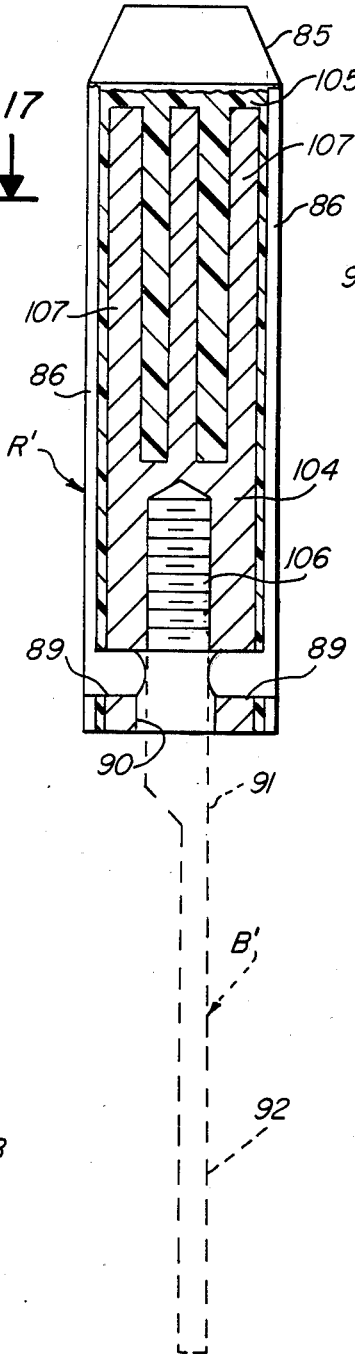

FIG. 14 is a side elevation of an alternative drive ram, partially broken away to show the interior construction and also showing a drive blade for nails in dotted outline.

Figure 15:
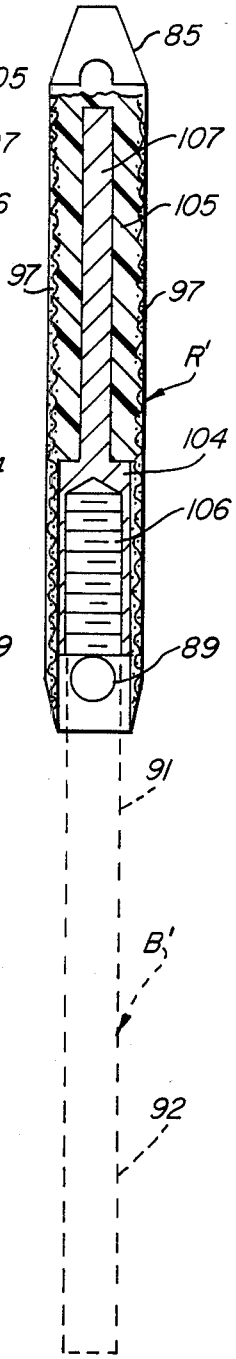

FIG. 15 is an end elevation of the alternative drive ram of FIG. 14, also partially broken away to show the interior construction.

Figure 16:
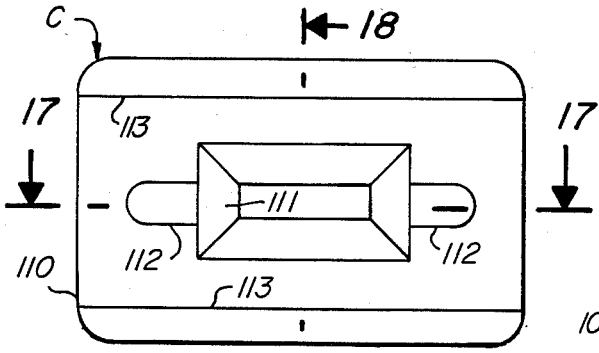

FIG. 16 bottom plan view of a housing cap of FIGS. 2 and 3.

Figure 17:
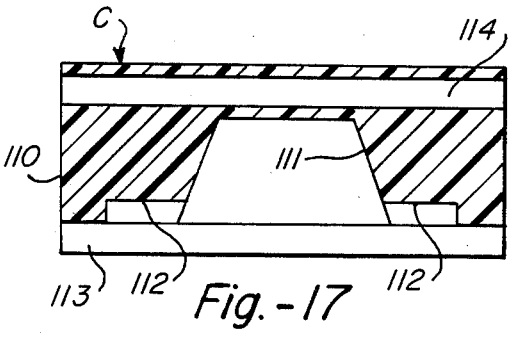

FIG. 17 is a longitudinal section thereof, taken along line 17—17 of FIG. 16.

Figure 18:
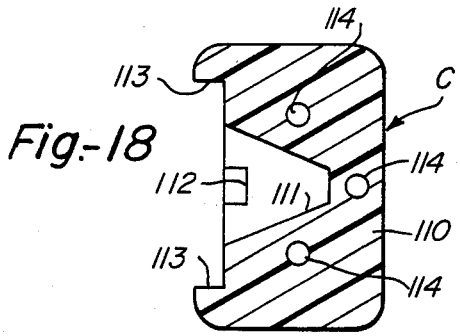

FIG. 18 is a lateral section thereof, taken along line 18—18 of FIG. 16.

Figure 19:
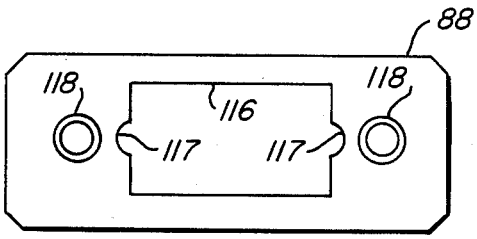

FIG. 19 is a bottom plan view of a plate to which are attached the upper ends of a resilient cord for returning the drive ram.

Figure 20:
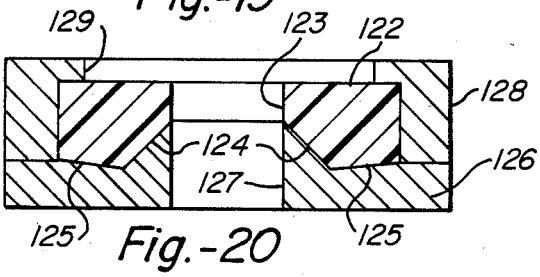

FIG. 20 is a vertical longitudinal section of a bumper installation.

DESCRIPTION OF THE PREFERRED EMBODIMENT

Figure 1:
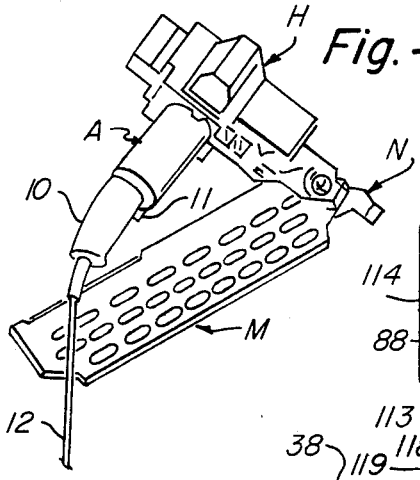
FIG. 1 is a perspective view, on a reduced scale, of an impact device of this invention, particularly adapted for driving nails.

A single motor impact device, such as for driving nails and the like, constructed in accordance with this invention, as illustrated in FIG. 1, may include generally a housing H in which is installed a reciprocating ram R of FIG. 2 adapted to move a conventional blade B′ of FIGS. 14 and 15 or B of FIG. 11 into engagement with the head of a nail fed from a conventional nail feeding magazine M into a nose piece N of a suitable nature. An auxiliary housing A, which serves as a combined gear and motor box, extends rearwardly from housing H to a handle 10, which in turn extends rearwardly from the gear and motor box and is provided with an electrical switch 11, to which an electrical cord 12 leads. As shown in FIG. 2, the reciprocable ram R may be disposed centrally of the housing H and the opposite sides of which are engagable by a pair of flywheels F and F′, which are rotated in opposite directions and each of which is moved toward the ram by pivotal movement of a pivotal, hollow mount 13 or 13′, each pivoted on a pin 14. Each flywheel is rotated in the direction of the arrow shown and is conveniently moved upwardly for engagement with the sides of the ram R by a lift pin 15. Each lift pin engages a socket 16, on the underside of the respective mount, while each flywheel is mounted on a shaft 17. Each flywheel shaft, as in FIG. 3, extends through a pair of bearings 18, and is in turn supported by the side walls of mount 13. A lock ring 19, inserted in a slot in each shaft 17, prevents axial movement of the shaft in one direction, at the rear bearing 18, while an enlargement 20 of the shaft, at the front bearing 18, prevents axial movement in the opposite direction. A pulley 21, by which the flywheel is rotated in a manner described later, is mounted on and keyed to enlargement 20. Each flywheel may comprise a hub 22, which is keyed to shaft 17, and a rim 23, with each of the hub and rim being provided with a central radial flange which is slotted for connection of the housing and rim by rivets 24 at spaced positions circumferentially of the hub.

As in FIGS. 2 and 3, each lift pin 15 is moved upwardly, or permitted to move downwardly, by a pivot arm 25 with the lower end of each lift pin 15 engaging a socket 26 on the respective pivot arm and the rear end of the latter being pivoted on a pin 27. The pivot arms 25 are connected together at the front by a cross bar 28, shown also in dotted lines in FIG. 2, so as to form a forked structure, with each pivot arm extending through a hole 29 in the housing H. Cross bar 28, at the center, is provided with a reinforcement 30 for a tapped hole (not shown) for attachment of the upper end of a conventional rod 31, the lower end of which engages the work piece when a nail is to be driven, thereby causing the flywheels F and F' to pivot upwardly for engagement with the sides of ram R, to move the ram R downwardly, so that blade B or B' of FIGS. 14, 15 or 11 will impact the nail to drive it. The length of rod 31 is conventionally proportioned so that the lower end of the rod will engage the work piece sufficiently before the nosepiece N that the ram R will begin to be moved downwardly as the lower end of nosepiece N reaches the workpiece.

An upper pin 32 extends into a well 33 in the top of each mount 13, as in FIG. 2, and is provided with an attached or integral cup 34 engaged by the lower end of a compression, snubbing spring 35 while the rounded lower surface of cup 34 pivots on the edge of well 33 as mount 13 or 13' moves upwardly or downwardly. Pin 32 and spring 35 extend upwardly within a sleeve 36, with snubbing spring 35 extending beyond the pin and its upper end engaging a disc 37, held in position by a set screw 38 threaded into the upper end of the sleeve. As will be evident, when the nail is driven and the device lifted to drive another nail at a different position, the upward pressure on cross bar 28 and pivot arms 25 will be released, enabling each snubbing spring 35 to return the corresponding flywheel to its initial position.

The housing H includes a central portion having side walls 40 and 40', each of which is provided with a laterally extending wing 41, together with an upper block 42 and a lower block 43. The upper and lower portions of the side walls are reinforced by pairs of upper and lower transverse bolts 44 which resist a portion of the stresses caused by movement of the ram and the reactions at the ends of pins 14, since precession forces produced by flywheel F will be counteracted by flywheel F', but are transmitted through the housing H. Also, compression forces produced by the thrust of the respective flywheels against the ram will also not counteract each other but will produce tension forces, as large as 1,000 to 3,000 lbs., again transmitted through the housing H. The front and the rear of the housing may be closed by a front plate P and a rear plate P', respectively, with the front plate P, as in FIGS. 4 and 5, being provided with a wing 45 at each side, corresponding to the configuration of wings 41 of the central portion of housing H. Inwardly extending, integral blocks 46 have sockets 47 for receiving the corresponding end of a pivot pin 14.

Figures 4, 5:
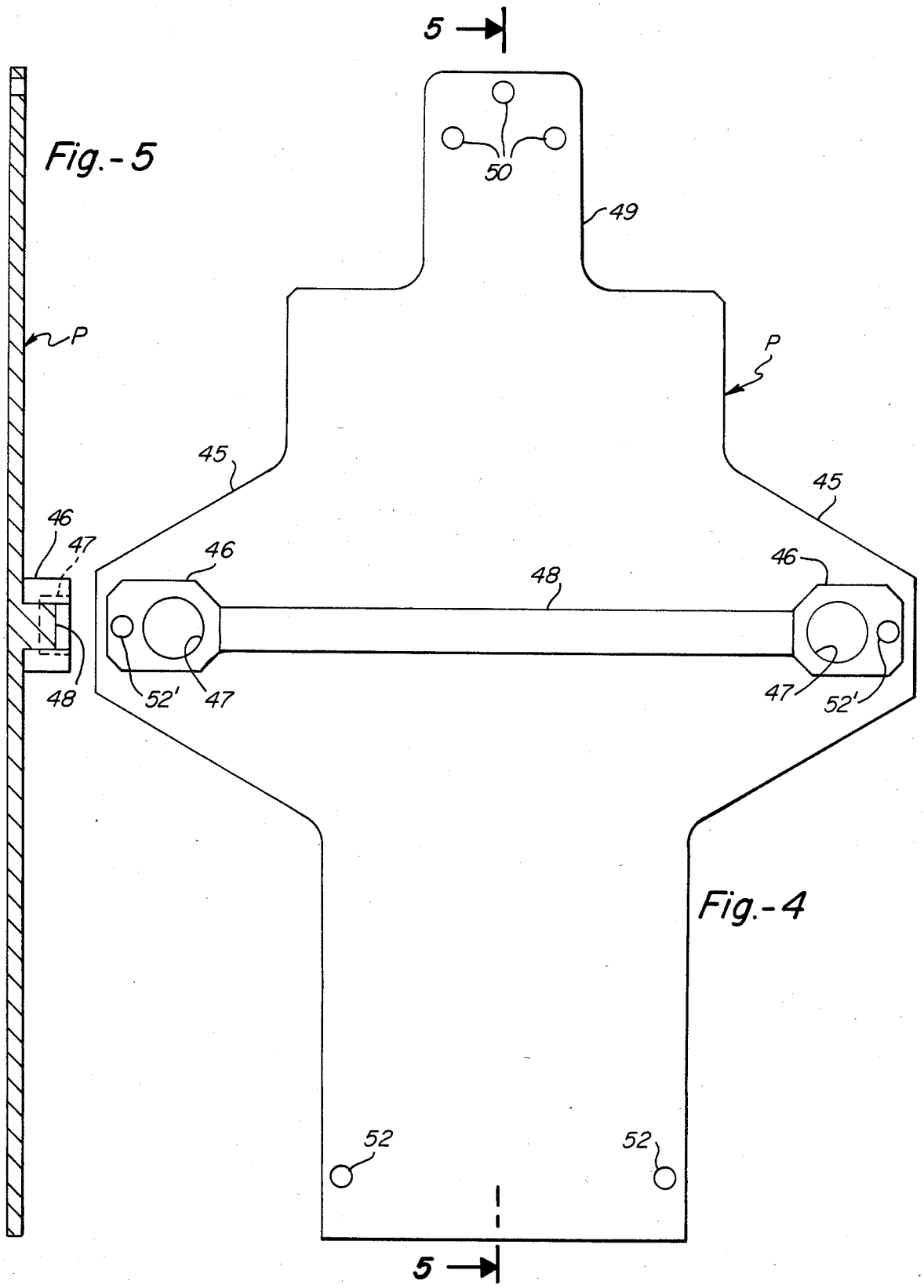
FIG. 4 is an elevation, from the inside, of a front cover plate of the device.
FIG. 5 is a central longitudinal section of the cover plate, taken along line 5—5 of FIG. 4.

In further accordance with this invention, a reinforcing bar 48 extends laterally between the blocks 46, as in FIG. 4, and is integral with the front plate P, as in FIG. 5, to withstand the stress imposed by the forces produced by the oppositely rotating flywheels and transmitted through the respective mounts 13 and pivot pins 14, to the housing, but canceled at the front through the reinforcing bar 48. Plate P' is also provided with inside blocks and sockets corresponding to blocks 46 and sockets 47, as well as with a reinforcing bar 48' of FIG. 3 but on the outside of the plate, as shown, opposite the pulleys 21, merging to the inside at the position of blocks 46. There are several advantages to the integral reinforcing bars 48 and 48', including the lack of necessity for installing a separate bar, such as a bolt or the like. Another advantage is that integral bars 48 and 48' are connected directly to sockets 47, to which the forces are transmitted directly from the flywheel mounts. A further advantage is that the housing H may be formed of plastic or other material less expensive and less resistant to stress, while the plates P and P' may be formed of steel. Each plate, as shown in FIG. 4 for front plate P, may be provided with a narrower upper section 49 which abuts a housing cap C of FIGS. 2 and 3, while each upper section 49 may be provided with holes 50 through which bolts 51 of FIG. 3 extend, as well as through a corresponding upper section of rear plate P', for securing a cap C in place. Additional holes 52, at each lower corner of front plate P, and holes 52', as in reinforcing blocks 46, permit the front plate to be attached to the center section of the housing, by cap screws engaging tapped holes in the center section of the housing.

Figure 6:
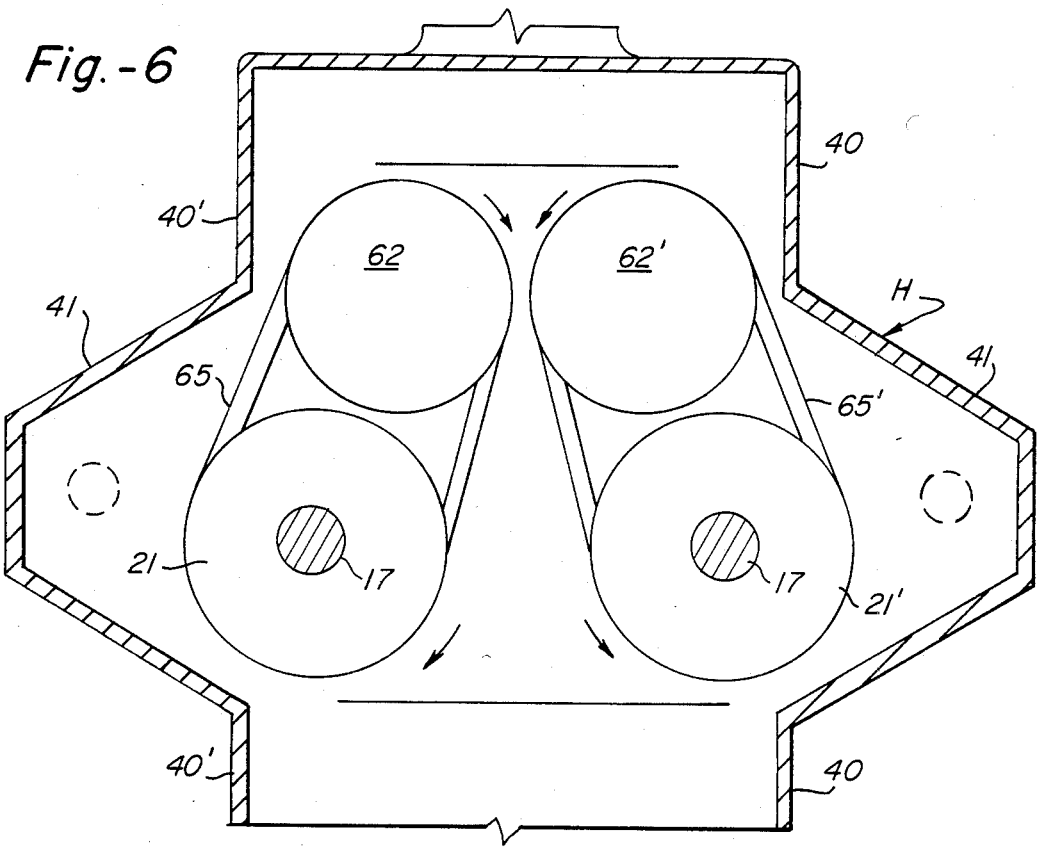
FIG. 6 is a fragmentary section, taken along line 6—6 of FIG. 3 and showing a drive arrangement for a pair of flywheels or rotors which are rotated in opposite directions.

In further accordance with this invention, the flywheels F and F' are rotated in opposite directions by a single motor 54 which is installed in auxiliary housing A, a portion of which is shown in FIG. 3. Motor 54 may have an integral speed reduction unit or an attached speed reduction unit, connected to a shaft 55 on which a drive gear 56 is keyed, with shaft 55 extending through a bearing 57 mounted within the auxiliary housing A. Motor 54 may be a universal type having an idle speed in the neighborhood of 26,000 r.p.m. with the gearing having a reduction ratio of between 2 to 1 and 4 to 1, such as 2.5 to 1. As in FIG. 7, drive gear 56 engages a larger gear 58, which in turn engages a second gear 59 of the same pitch diameter so that gear 58 will drive gear 59 at the same speed but in the reverse direction, drive gear 56 and gears 58 and 59 being represented in FIG. 7 by dotted circles corresponding to the respective pitch diameters. As shown, drive shaft 55 is offset slightly from the vertical plane of the engaging pitch circles of gears 58 and 59 so that drive gear 56 will engage larger gear 58 only. Gear 58 is keyed to a shaft 60, as in FIG. 3, at a keyway 51 of FIG. 8, while shaft 60 is integral with a pulley 62 having a V-notch 63. Shaft 60 is supported by bearings 64 mounted in housing A, while similar bearings support a shaft 60', of FIG. 7, to which gear 59 is keyed and which is integral, in a manner similar to shaft 60, with a pulley 62' of FIG. 6. A V-belt 65 connects pulley 62 with pulley 21, engaging the notch 63 of pulley 62 and a notch 66 of pulley 21, for rotating flywheel F. A similar belt 65' connects pulley 62' with a pulley 21' for rotating flywheel F'. It will be evident from the construction thus described that the flywheels may be rotated in opposite directions from a single motor, indicated by the arrows of FIG. 6, and will be rotated at the same speed due to the identical diametric pitch of gears 58 and 59.

In further accordance with this invention, the V-notch 63 of pulley 62, as in FIG. 9, is conventional, but notch 66 of pulley 21, as in FIG. 10, has a similar angularity at the inside to the notch of pulley 62, but outwardly therefrom parallel side walls 67 which are spaced apart a distance slightly greater than the width of the belt. The pulleys 62' and 21' for rotating the flywheel F' may be identical in construction with pulleys 62 and 21, respectively, for rotating the flywheel F. The effect of this variation in the notch 66, as illustrated on an enlarged scale in FIGS. 9 and 10, is to permit the V-belt 65 or 65' of FIG. 6 to move downwardly between side walls 67 and the belts to slip slightly on the respective pulleys 21 and 21', when the flywheels are moved upwardly and into engagement with the respective sides of ram R, since the distance between the centers of pulleys 62 and 21 driving flywheel F, as well as between the centers of pulleys 62' and 21' driving flywheel F', will decrease. Thus, when the flywheels tend to slow down through engagement with the sides of the ram, the speed of the motor will not be similarly reduced due to belt slippage but, after the flywheels are returned to their initial position, the belts will again tighten into the V-notches 66 of the flywheel pulleys and the motor will be able to accelerate the flywheels up to the previous speed more quickly. Such ability to accelerate the flywheels enables a greater number of nails, for instance, to be driven within a given period of time. In fact, with such a construction, the device of this invention has been used to drive a series of two inch nails in succession by manual movement of the device from the position of one nail to the position of the next nail sufficiently quickly that one nail could be driven every 333 milliseconds, but the motor was able to accelerate the flywheels up to the desired speed as soon as the next nail position was reached. For 3.5 inch nails, one nail could be driven between every 400 milliseconds and each second, depending on the type of wood or other material into which the nails were being driven.

Figure 7:
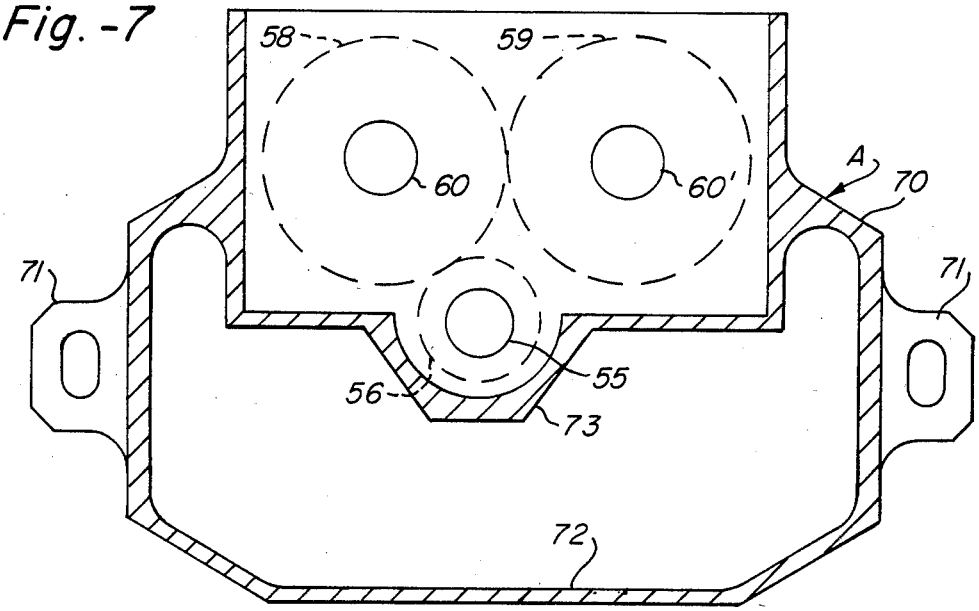
FIG. 7 is a fragmentary section, taken along line 7—7 of FIG. 3, showing the dual drive arrangement thereof.

The auxiliary housing A may include a casting 70, of FIGS. 3 and 7, which abuts against rear plate P' and conveniently interfits with integral tension bar 48', being attached to plate P' by cap screws (not shown) extending through slotted ears 71 of FIG. 7 for locking the auxiliary housing in an adjusted position. Casting 70 has a bottom wall 72 and an interior partition 73 which provides an appropriate configuration to receive the gears 56, 58 and 59, bearings 57 for shaft 55 and bearings 64 for shaft 60 to which gear 58 is keyed and which, in turn, is integral with pulley 62, as well as corresponding bearings for shaft 60' to which gear 59 is keyed and which, in turn, is integral with pulley 62'. Bearings 57, 64 and the bearings for shaft 60 may be held in place by a rear plate 74 attached to casting 70 by conventional cap screws (not shown), while the space above gears 58 and 59 may be closed by a top plate 75. Lower wall 72, as in FIG. 3, may be provided with a depending boss 76 which is threaded, as shown, to receive an adjusting bolt 77, the head 78 of which may engage a slot 79 in an ear 80, integral with rear housing plate P' on the rear side thereof. The head of bolt 78 may be placed in slot 79 by slipping the stem of the bolt, adjacent the head, into an upright slot 81 in ear 80, centered above transverse slot 79. Bolt 77 may be locked in position by a set screw 82 extending into a tapped hole in boss 76.

The sides 83 and 83' of ram R, shown in FIGS. 2 and 11–13, may be provided with a friction surface, as of the type described later, while the lower ends of the ram sides, for initial engagement by the flywheels F and F', are also provided with a taper or bevel 84, in accordance with my aforesaid application Ser. No. 19,073. The top of the ram, as in FIGS. 11 and 12, may be provided with a pyramidal configuration 85, for a purpose described later, while each end edge may be provided with a groove 86 for reception of an elastic cord 87 of FIG. 2. Cord 87 may be of the bungee type for returning the ram to the position of FIG. 2 after a nail has been driven and extends from a plate 88, shown in greater detail in FIG. 19 and described later, but mounted just below cap C, as in FIG. 2. Cord 87 extends from plate 88 down wardly along one groove 86, then through a transverse hole 89 of FIGS. 11 and 12 adjacent the lower end of the ram, across oval axial hole 90 at the lower end of the ram, through the opposite hole 89 and upwardly along opposite groove 86 to plate 88. A blade B, shown partially in FIG. 11 and the lower end of which is similar to a modified blade B' shown in dotted line outline in FIGS. 14 and 15 in connection with an alternative ram R', has a cylindrical head 91 which fits within oval hole 90 and a conventional lower portion 92, shown in FIGS. 14 and 15, which is slightly arcuate in cross section and is adapted to engage the head of a nail for driving purposes while avoiding the head of the next nail carried by the feeding mechanism M of FIG. 1, thereby being concave on the side facing the next nail. Cord 87 may pass around the head 91 of blade B, within oval hole 90 when extending through transverse holes 89. An upper rod 93 may be attached, as by welding, or may be integral with head 91 and extend upwardly through a central longitudinal hole 94 in the ram to an upper socket 95 of FIG. 11. Socket 95 receives a nut 96 or similar fastening device, which engages the upper end of the rod, such as threaded, and thereby locks the rod and blade to the ram. The grooves 86 conveniently extend to the lower end of the ram, as in FIGS. 12 and 13, even though the cord extends through transverse holes 89 above the lower end.

In accordance with this invention, the ram R of FIGS. 11–13 is formed of suitable fabric layers 97 of natural fiber, preferably long fiber cotton cloth, impregnated and molded in a suitable plastic 98, preferably polyurethane. This combination appears to have a high resistance to wear, to provide a high coefficient of friction and to resist cracking or breakage, particularly when used in conjunction with flywheels whose rims 23 are formed of steel which is highly polished on the periphery. The superiority of the cotton and polyurethane became evident after the following unsatisfactory attempts to solve the problem:

(1) A soft rubber and cloth combination produced undesirable odors and smoke during use.

(2) A layer of the polyurethane deposited on the flywheels, for use with a metal ram, did not wear satisfactorily.

(3) An automotive brake lining proved to be too brittle for the impacts to which it was subjected.

(4) Glass fibers embedded in Ryton, a polyphenyl sulfide plastic available from Phillips Petroleum Corporation, proved to be partially successful, since the glass crushed after 35,000 nails were driven.

(5) Fiber glass layers impregnated with polyurethane proved to be too brittle, crushing after a few nails had been driven.

(6) Aluminum trihydrate contained in polyurethane produced undue wear due to abrasion.

(7) Copper particles embedded in polyurethane produced an unduly low coefficient of friction.

(8) Epoxy resin impregnated metal cloth layers, with iron powder, also produced an unduly low coefficient of friction.

(9) Potassium titanate particles embedded in polyurethane produced an unduly low coefficient of friction.

(10) Conventional wire screen embedded in polyurethane produced an unduly low coefficient of friction.

(11) Fabric layers impregnated with a very hard polyester resin produced an unduly low coefficient of friction.

(12) Layers of a fabric formed of fibers of DuPont Kevlar, an aramide resin used in tires and belts for its high tensile strength, impregnated with polyurethane, was unable to withstand the compressive stresses produced by the flywheels.

Failure of the above to produce satisfactory results was surprising, since each had been used successfully in other friction applications. It was concluded that a medium hard plastic or rubber used with a natural fiber would be satisfactory, such as having a Durometer hardness range of about D-60 to D-80, with a preferred range of D-70 to D-75.

Ram R may be produced by molding with tapers 84 and pyramid 85 produced during molding, while any of grooves 86, holes 89 and 90, hole 94 and socket 95 may be produced during molding or afterward, such as holes 89 and 94 drilled after molding and the remainder produced during molding.

Also in accordance with this invention, a further preferred construction of the ram is the ram R′ of FIGS. 14 and 15, which comprises a metal insert 104 molded into a plastic section 105 which forms the periphery of the ram and surrounds the insert 104. Metal insert 104 is provided with a threaded socket 106 for receiving the threaded upper end of blade B′. Section 105 is formed of a suitable plastic, such as polyurethane, along each side of which may be embedded layers 97 of suitable fabric, such as cloth of long fiber cotton, to provide a friction layer at each side which resists the wear of the flywheels F and F′. Although only one layer of fabric 97 is shown at each side of ram R′, it will be evident that more than one layer is preferably provided. Molded plastic section 105 has a pyramidal top 85, end slots 86 for a return cord and the outer portion of transverse holes 89, while metal insert 104 is provided with the remainder of transverse holes 89 and an axial oval hole 90, similar to ram R.

In still further accordance with this invention, the bond between the plastic section 105 and the metal insert 104 is enhanced by the presence of a series of integral, upright, metal fingers 107, around each of which the plastic flows, as during molding. Attempts to provide a friction layer on the outside of a lower metal portion by plastic which also formed an upper portion of the ram, produced unsatisfactory results when the metal insert had merely a rectangular cross section. Also, a single small stem, projecting upwardly from the insert, did not provide a sufficient bond between the plastic and the metal of the insert to prevent breakage of the plastic within a short time after the beginning of use. If desired, the fingers 107 of the ram R′ of FIGS. 14 and 15 may be provided with lateral holes, through which the plastic matrix may extend, as during molding.

Cap C of FIGS. 16–18, which is mounted at the upper end of housing H, as in FIGS. 2 and 3, may comprise a body 110 formed of a suitable rubber or synthetic rubber, such as polyurethane, and may include a pyramidal socket 111 which corresponds in shape to the pyramid 85 at the top of ram R or R′, to receive and guide the upper end of the ram when the elastic cord 87 returns the ram. The cap is provided with a slot 112 at each end of socket 111, which accommodates the upper ends of cord 87, as described later. Cap C may be provided with a lip 113 at each side which fits over opposite sides of the top block 42 of the housing H, as in FIG. 2, as well as three lateral holes 114 and 118, as in FIGS. 2 and 13 to receive bolts 51 of FIG. 3.

As indicated previously, the cord plate 88 is positioned below cap C within a notch provided for the purpose in the top block 42, as in FIG. 2. Plate 88, as in FIG. 19, is provided with a central rectangular opening 116 through which the upper end of the ram moves, with a small groove 117 at each end of the opening, corresponding to the position of slots 112 of the Cap C, to accommodate cord 87 as it extends into grooves 86 in the ends of the ram. Thus, slots 112 and grooves 117 complement grooves 86 of the ram and provide clearance for the cord. A pair of tapered holes 118 permit the opposite ends of the cord to be extended downwardly therethrough and a knot tied in the cord or a hog ring attached thereto, to wedge the respective end of the cord within a tapered sleeve 119 of FIG. 2, which engages the respective hole 118 of FIG. 19 to secure each end of the cord to the plate. The upper surface of top block 42 of the housing may be provided with wells at the position of holes 118, to receive the sleeves 119. In the event that the sides of ram R wear due to continued use, such as after driving many thousands of nails, or for some other reason, ram R or cords 87 require replacement, a ram assembly may be formed of ram R, cords 87 and plate 88, with a knot or hog ring in each end of cords 87 after passage through the ram and holes 118 in plate 88, as well as tapered sleeves 119 installed. Cap C may be readily removed by removing bolts 51 so that the previous ram assembly may be removed and replaced by a new one, after which cap C may be replaced. As will be evident, such replacement of a ram assembly may be accomplished in a very short time.

A bumper 122, illustrated in FIG. 20, may be positioned in the upper end of nose piece N and is engaged by the lower end of the ram, if the ram should accidentally be propelled a distance greater than that normally utilized to drive a nail. Bumper 122 may be formed of a suitable resilient material, such as polyurethane, and has a central hole 123 which is smaller than the bottom of the ram, but will easily permit blade B to pass through. From the bottom of hole 123, a downwardly inclined flare 124 extends outwardly, while the remainder of the underside of the bumper may be provided with an inwardly and downwardly extending taper 125, to engage corresponding contours of a lower clamp 126, as of metal, to prevent the material of the bumper from being driven inwardly and thereby tend to close hole 123, in the event of repeated impacts by the ram. Lower clamp 126 is provided with a central hole 127, corresponding to hole 123, while an upper clamp 128 may be provided with an annular, upper rim 129 which provides adequate clearance for the lower end of the ram. The upper and lower clamps may be attached together and installed in the upper end of nose piece N in a conventional manner.

It will be understood that certain features of the impact tool of this invention may be utilized in tools used for purposes other than driving nails, such as the friction surfaces of the sides of the ram, particularly when the peripherys of the flywheels are polished steel or the like. Thus, blades or impact tools for accomplishing purposes other than driving nails may be utilized in conjunction with a ram of this invention.

Although a preferred embodiment of this invention and variations thereof have been illustrated and/or described, it will be understood that other embodiments may exist and additional changes be made without departing from the spirit and scope of this invention.

What is claimed is:

1. An impact device comprising:

A. a housing;

B. a ram means mounted on said housing for reciprocating movement for delivering an impact to an object and returning to a rest position;

C. ram moving means for moving said ram means from said rest position to impact an object and for accelerating said ram means to a desired impact velocity, said ram moving means including:

(1) two flywheels pivotably mounted on said housing adjacent to aaid ram means for movement from ready positions spaced from said ram means toward each other and into abutting contact with said ram means, (2) flywheel moving means for moving said flywheels from said ready positions toward each other and into abutting contact with said ram means and away from each other back to said ready positions, said flywheel moving means including (a) a workpiece engaging means for moving said flywheels toward each other and into abutting contact with said ram upon engaging a workpiece and (b) flywheel return means on said housing for biasing said flywheels away from each other and toward said ready positions and moving said flywheels back to said ready positions when said workpiece engaging means is not engaging a workpiece; and (3) flywheel rotating means for rotating each of said flywheels in a direction to drive said ram means toward an impact delivering position upon engagement with said ram means, said flywheel rotating means including (a) a motor having a drive shaft, (b) a first pulley means associated with each flywheel and rotatably mounted on aaid housing, each of said first pulley means including a V-shaped peripheral groove, (c) coupling means for coupling each of said first pulley means together to rotate together but in opposite directions, (d) connecting means mounted on said housing for connecting said motor to one of said first pulley means for rotating said first pulley means, (e) a second pulley means connected to each flywheel and rotatably mounted on said housing, (f) a V-shaped belt means for connecting each of said second pulley means to an associated one of said first pulley means to rotate said second pulley means in correspondence with rotation of said associated first pulley means, (g) each of said second pulley means including a compound groove means extending from an inner portion of each of said second pulley means to the outer peripheral edge of said second pulley means for accommodating said belt means, said compound groove means including a V-shaped portion which is located adjacent to the inner portion of said second pulley means and which is sized and shaped to receive said V-shaped belt means snugly enough so that movement of said belt means is transferred to said second pulley means, said V-shaped portion being located to snugly receive said belt means when said flywheels are in said ready positions whereby rotation of said motor drive shaft is transmitted to said flywheels to rotate said flywheels at a predetermined speed, said flywheel return means biasing said second pulley means V-shaped groove portions against said V-shaped belt means when said flywheels are in said ready positions, and a second portion having side walls which are spaced apart far enough so said second pulley means is disconnected from said belt means when said second pulley means is positioned to have said belt means located in said groove means second portion whereby said flywheels are disconnected from said motor when said belt means is located in said groove second portion and rotate under their own inertia for driving said ram means, said groove means second portion being placed on said second pulley means to have said belt means positioned therein after said flywheels have been moved out of said ready positions and have been moved toward each other by said flywheel moving means.

2. In an impact device, as defined in claim 1 wherein:

the side of said ram means engagable by said flywheels is provided with a surface formed by a natural fiber embedded in a medium hard plastic or rubber.

3. In an impact device as defined in claim 2, including:

a surface formed by a natural fiber embedded in a plastic on each side of said ram means.

4. In an impact device as defined in claim 3, wherein:

said ram is provided with a lower axial socket and a central hole extending from said socket to the opposite end of said ram; and said tool means is provided with an enlargement receivable in said lower socket, a rod extendable through said central hole and means for securing the opposite end of said rod to said ram.

5. In an impact device as defined in claim 4, wherein:

said ram is formed of layers of woven natural fiber embedded in a plastic;

each edge of said ram is provided with a longitudinal groove and an aperture extends through said ram at position to intersect said socket, whereby a resilient cord for returning said ram after an impact may extend through said aperture and around a portion of said tool means in said socket, said resilient cord thereby extending along each said groove to a normal position adjacent the opposite end of said ram; and said device having means at said normal position for attachment of said cord.

6. In an impact device as defined in claim 3, wherein:

said ram is provided with a central metal core which extends from one end toward the opposite end, the portion of said core at said one end being provided with means for attachment of said tool means and spaced fingers extending in said ram toward said opposite end; and said fingers being embedded in a plastic and the sides of said ram on opposite sides of said core being formed of layers of woven natural fiber embedded in said plastic.

7. In an impact device as defined in claim 6, wherein:

each edge of said ram means is provided with a longitudinal groove and an aperture extends through said ram means adjacent to one end thereof, whereby a resilient cord for returning said ram means after an impact may extend through said aperture adjacent to one end of said ram means, said resilient cord thereby extending along said groove to a normal position adjacent to an opposite end of said ram means; and means at a normal position for attachment of said cord.

8. In an impact device as defined in claim 2, wherein:

said natural fiber is long fiber cotton and said plastic is polyurethane.

9. In the impact device as defined in claim 1 wherein:

said ram means is provided with a pyramidal end; and a bumper formed of resilient material and having a socket corresponding in shape to an end of said ram means mounted in a position whereby said pyramidal end of said ram means engages said socket upon return of said ram means from an impact stroke.

10. In an impact device as defined in claim 9, wherein:

said bumper is provided with a groove at each end of said socket for receiving the ends of a resilient cord for returning said ram from an impact stroke.

11. In an impact device as defined in claim 10, wherein:

said tool means is adapted to drive a series of objects into an article;

said device is provided with a nose piece engageable with said article;

said nose piece is provided with a bumper engageable by the end of said ram means adjacent to said tool means in the event said ram means is moved further than a normal stroke when said tool means is driving an object into said article, said bumper being formed of resilient material and having an aperture through which said tool means moves and an outwardly inclined surface extending from said aperture in the direction of movement of said tool; and clamping means for mounting said bumper on said nose piece, said clamping means being provided with a projection having slanting surfaces adapted to abut said inclined surfaces of said bumper and an aperture corresponding to said aperture of said bumper, said clamping means being formed of less resilient material than said bumper.

12. In an impact device as defined in claim 1, wherein:

each said flywheel is provided with a polished metal peripery; and each side of said ram is provided with a surface formed by a woven natural fiber embedded in a plastic.

13. In an impact device of claim 1 wherein said belt means includes:

a compliant transmission means coupling said each of second pulley means means to an associated flywheel, said compliant transmission means being operative to alter the relative rotation between said second pulley means and said flywheel upon the engagement of said ram means against said flywheel.

14. In the impact device defined in claim 1 including ram means returning means which comprises elastic cord means extending and attached to said ram means from a position spaced longitudinally from said ram means opposite the direction of movement of said ram means when driven by said flywheels;

cord attaching means removably mounted on said housing at said position;

cap means removably mounted on said housing to hold said cord attaching means on said housing, said cord and said ram means being mounted on said cord attaching means for permitting the removal of said cord attaching means, said cord means and said ram means as a unit when replacement of either said ram means or said cord means is desired.

15. In an impact device as defined in claim 14, wherein:

said cord attaching means includes a plate provided with an aperture through which the end of said ram means may move for engagement with said burners; and said bumper is readily movable, whereby said plate, cord means and ram means may be removed and replaced as a unit upon removal of said bumper.

16. In an impact device as defined in claim 14 further including a pyramidal shaped socket in said cap means for receiving and accomodating the top end of said ram means.

17. In the impact device defined in claim 14 further including:

means within said housing for supporting said ram means and said ram returning means within said impact device, said supporting means, said ram means and said ram returning means being removable from said impact device as a single unit.

18. The improvement recited in claim 17 wherein:

said ram returning means comprises an elastic cord means affixed to said ram means.

19. The improvement recited in claim 18 wherein:

said elastic cord means is further affixed to said supporting means.

* * * * *